United States Patent [19]

Tsuruoka

[11] Patent Number: 5,055,744

[45] Date of Patent: Oct. 8, 1991

[54] DISPLAY DEVICE

[75] Inventor: Yoshihisa Tsuruoka, Mobara, Japan

[73] Assignee: Futuba Denshi Kogyo K.K., Mobara, Japan

[21] Appl. No.: 278,242

[22] Filed: Nov. 30, 1988

[30] Foreign Application Priority Data

Dec. 1, 1987 [JP] Japan ..... 62-301590

[51] Int. Cl.[5] ..... G09G 3/04

[52] U.S. Cl. ..... 315/169.1; 313/497

[58] Field of Search ..... 315/169.1; 313/422, 313/497

[56] References Cited

U.S. PATENT DOCUMENTS

| | | | |
|---|---|---|---|
| 4,227,117 | 10/1980 | Watanabe et al. | 313/422 X |
| 4,404,493 | 9/1983 | Nonomura et al. | 313/422 |
| 4,459,514 | 7/1984 | Morimoto et al. | 315/169.1 |
| 4,595,862 | 6/1986 | Morimoto et al. | 315/169.1 X |
| 4,626,741 | 12/1986 | Morimoto et al. | 313/497 |
| 4,703,231 | 10/1987 | Tomii et al. | 313/422 X |
| 4,816,724 | 3/1989 | Hamada et al. | 313/422 X |

*Primary Examiner*—Eugene R. LaRoche
*Assistant Examiner*—Do Hyun Yoo
*Attorney, Agent, or Firm*—Oblon, Spivak, McClelland, Maier & Neustadt

[57] ABSTRACT

A display device capable of decreasing the number of drivers required for driving electrodes, decreasing the number of filamentary cathodes to reduce power consumption and utilizing electrons with high efficiency. In the display device, filamentary cathodes are arranged in parallel with control electrodes and in a manner to interpose two or more control electrodes between each adjacent two filamentary cathodes. Also, each deflecting control electrode is constituted by adjacent two control electrodes positioned right below each of the filamentary cathodes and scanned while being applied thereto a potential by way of a deflecting circuit. Further, to the control electrodes other than the deflecting control electrodes is constantly applied a potential negative with respect to the filamentary cathodes.

5 Claims, 3 Drawing Sheets

DISPLAY DEVICE

BACKGROUND OF THE INVENTION

1. Field of the Invention

This invention relates to a display device represented by a graphic display device using a fluorescent display tube, and more particularly to such a display device adapted to substantially decrease the number of drive circuit elements and reduce power consumption.

2. Description of the Prior Art

A graphic display device using a fluorescent display tube which has been conventionally known in the art is generally constructed in such a manner as shown in FIG. 5.

More specifically, a fluorescent display tube used in the conventional display device which is generally indicated at reference numeral 1 in FIG. 5 includes a substrate 2 made of an insulating material, on which a plurality of stripe-like anode conductors are arranged. The anode conductors constitute anodes 3 in cooperation with phosphor layers deposited thereon. In the tube of the type wherein its luminous display is observed through the substrate 2, the substrate and anode conductors each are made of a light-permeable material. The fluorescent display tube also includes a front cover 4 arranged opposite to the substrate 2, on which a plurality of filamentary cathodes 6 are stretchedly arranged through cathode supports 5. On the substrate 2 are fixed spacers 7, through which a space is defined between the substrate 2 and the anodes 3. Further, the fluorescent display tube includes a plurality of wire-like control electrodes 8 arranged so as to extend in a direction across the anodes 3. The substrate 2 and front cover 4 are hermetically joined together through side plates 9 to form an envelope, which is evacuated to high vacuum and then an evacuation hole 10 of the envelope is sealedly closed with a lid 11, resulting in the fluorescent display tube 1.

In the fluorescent display tube or device 1 constructed as described above, turning-on of the cathodes 6 for the heating causes them to emit electrons. Also, each intersection between the anodes and the control electrodes arranged across each other constitutes each picture cell. Accordingly, when voltages are selectively applied to the anodes 3 and control electrodes 8 arranged across each other, respectively, electrons emitted from the cathodes 8 impinge on phosphor layers of picture cells selected, resulting in a desired luminous display.

Thus, the conventional fluorescent display tube for the conventional graphic display device generally employs a matrix drive system by means of the anodes and control electrodes. Such a matrix drive system includes a simple matrix system wherein control electrodes are selectively driven one by one and a dual wire scanning system as proposed in Japanese Utility Model Application Laying-Open Publication No. 57-162692 by the assignee wherein a drive signal is concurrently applied to adjacent two control electrodes, so that each anode interposed between the so-selected two control electrodes forms a picture cell. Also, an anode multi-matrix system has been partially put into practice, which is intended to decrease the number of drive circuits on a control electrode side, as disclosed in Japanese Patent Application Laying-Open Publication No. 202050/1982.

Unfortunately, in each of the simple matrix system, dual wire scanning system and anode multi-drive system which are in the category of the matrix drive system, it is required to separately drive the anodes and control electrodes, resulting in an increase in the number of drive circuit elements (hereinafter referred to as "drivers") for the anodes and control electrodes.

More specifically, supposing that, for example, a simple matrix system has 640 picture cells and 400 picture cells arranged in its lateral and longitudinal directions, respectively, or 256,000 ($=640\times400$) picture cells in all, it requires 1040 drivers ($=640+400$).

Accordingly, an increase in the number of picture cells for accomplishing a graphic display of high density leads to an increase in the number of drivers correspondingly, so that costs of circuits for the drivers and costs for manufacturing the device are significantly increased. Also, a graphic display of high density causes a decrease in duty factor, so that an increase in anode voltage is required. Unfortunately, this requires the drivers to withstand a voltage as high as 100 volts to several hundred volts, resulting in a further increase in the costs.

Also, in order to cause all the anodes to carry out a uniform luminous display, the anodes are required to uniformly emit electrons. However, this causes an increase in the number of cathodes, resulting in effective utilization of electrons being deteriorated and power consumption being increased.

SUMMARY OF THE INVENTION

The present invention has been made in view of the foregoing disadvantage of the prior art.

Accordingly, it is an object of the present invention to provide a display device which is capable of substantially decreasing the number of drivers required for driving electrodes.

It is another object of the present invention to provide a display device which is capable of decreasing the number of filamentary cathodes to reduce power consumption.

It is a further object of the present invention to provide a display device which is capable of utilizing electrons with high efficiency.

In accordance with the present invention, a display device is provided. The display device includes an anode group including phosphor-deposited anodes, a control electrode group including control electrodes arranged above the anode group in a direction across the anode group, and filamentary cathodes for emitting electrons. The anode group and control electrode group are selectively driven to cause electrons emitted from the cathodes to impinge on regions of the anodes positioned at intersections between the anode group and the control electrode group and in proximity thereto, resulting in a luminous display. The filamentary cathodes are stretchedly arranged above the control electrode group in a manner to be in parallel with the control electrodes and interpose two or more such control electrodes between each adjacent two such filamentary cathodes. The display device also includes deflecting means arranged right below the filamentary cathodes for varying a potential between each adjacent two such control electrodes to deflect the electron beam emitted from the filamentary cathodes. The display device also includes means for applying a predetermined potential to the control electrodes other than the control electrodes to which the deflection potential is applied.

As described above, in the present invention, the filamentary cathodes are arranged in parallel with the control electrodes and in a manner to interpose two or more control electrodes between each adjacent two filamentary cathodes. Also, each deflecting control electrode is constituted by adjacent two control electrodes positioned right below each of the filamentary cathodes and scanned while being applied thereto a potential by means of the deflecting means. Further, to the control electrodes other than the deflecting control electrodes is constantly applied a potential negative with respect to the filamentary cathodes.

Such construction of the present invention causes electrons emitted from the filamentary cathodes to be constricted into a beam-like shape and then deflected depending on a potential difference between the adjacent two deflecting control electrodes while passing through a gap between the deflecting control electrodes.

Accordingly, in the present invention, a variation in potential difference between the deflecting control electrodes depending on an interval between picture cells causes an increase in the number of picture cells covered by each of the filamentary cathodes.

BRIEF DESCRIPTION OF THE DRAWINGS

These and other objects and many of the attendant advantages of the present invention will be readily appreciated as the same becomes better understood by reference to the following detailed description when considered in connection with the accompanying drawings in which like reference numerals designate like or corresponding parts throughout; wherein.

DETAILED DESCRIPTION OF THE PREFERRED EMBODIMENT

Now, a display device according to the present invention will be described hereinafter with reference to the accompanying drawings.

Figure 1:
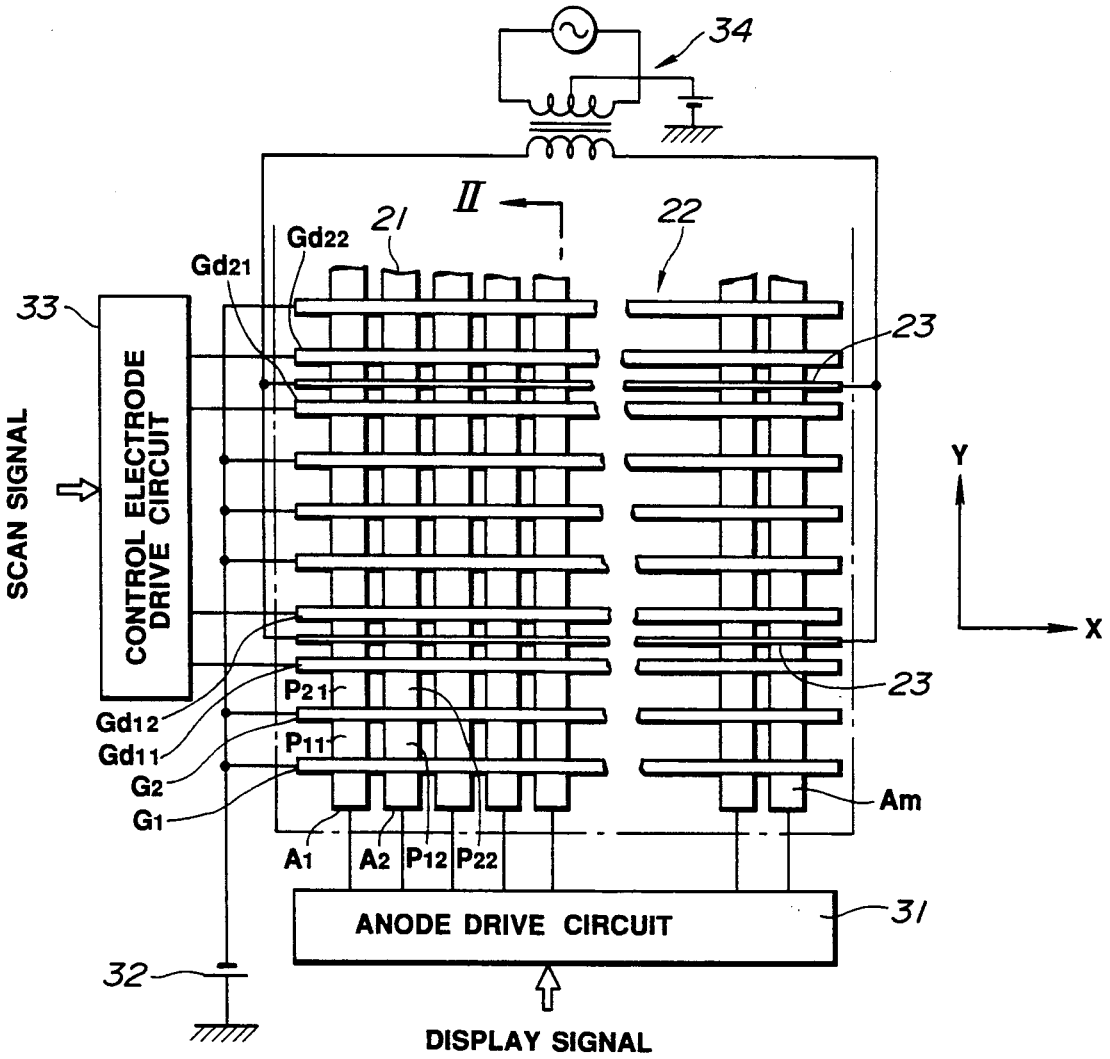
FIG. 1 is a schematic plan view showing an electrode section in an embodiment of a display device according to the present invention.

FIG. 1 schematically shows an electrode section in an embodiment of a display device according to the present invention.

A display device of the illustrated embodiment includes an anode group 21 including anodes $A_1$, $A_2$, - - - $A_m$arranged in parallel with one another in a Y direction and each having a phosphor deposited thereon which is adapted to emit light due to impingement of electrons thereon. The display device also includes a control electrode group 22 including a plurality of control electrodes $G_1$, $G_2$, - - - $Gd_{11}$, $Gd_{12}$, - - - arranged above the anode group 21 so as to extend in a direction across the anode group 21.

Also, the display device includes a plurality of filamentary cathodes (hereinafter referred to as "cathodes") 23 which are stretchedly arranged in a manner to extend in parallel with the control electrode group 22 and interpose two or more control electrodes between each adjacent two cathodes 23. In the illustrated embodiment, the cathodes 23 are arranged at intervals of five control electrodes. Adjacent two control electrodes Gd ($Gd_{11}$, $Gd_{12}$, $Gd_{21}$, $Gd_{22}$, - - - ) positioned right below each of the cathodes 23 each serve as a deflecting control electrode. Each of the cathodes 23 is preferably arranged above a center between a pair of the deflecting control electrodes.

Figure 2:
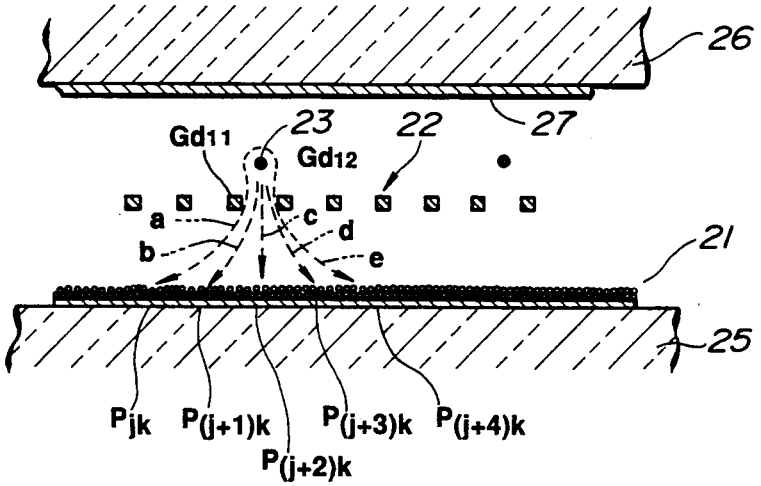
FIG. 2 is a fragmentary sectional view taken along an arrow II of FIG. 1, which schematically shows a sectional structure of the electrode section shown in FIG. 1.

FIG. 2 is a fragmentary sectional view taken along an arrow II of FIG. 1, which schematically shows a sectional structure of the electrode section shown in FIG. 1. In FIG. 2, reference numerals 25 and 26 designate a substrate and a front cover, respectively. On an inner surface of the front cover 26 is depositedly arranged a diffusion electrode 27.

To the anode group 21 is applied, through an anode drive circuit 31, a voltage reinforced depending on a display signal generated from a display control circuit (not shown). The control electrode group 22 except the deflecting control electrodes Gd are commonly connected so that a predetermined voltage which is negative with respect to the cathodes 23 may be constantly applied thereto through a power supply 32.

To the deflecting control electrodes Gd is applied a deflection voltage, which will be described below, through a control electrode drive circuit 33 acting as deflecting means to which a scan signal is supplied. The cathodes 23 are excited by a cathode heating circuit 34.

In the display device of the illustrated embodiment constructed as described above, regions of the anode group 21 interposed between each adjacent two control electrodes constitute picture cells $P_{11}$, $P_{12}$, - - - $P_{21}$, $P_{22}$, - - - .

Now, the manner of operation of the display device of the illustrated embodiment will be described hereinafter.

In FIG. 2, picture cells on one of the anodes A constituting the anode group 21 defined by each pair of the control electrodes including the deflecting control electrodes Gd are indicated at $P_{jk}$, $P_{(j+1)+k}$, $P_{(j+2)k}$, $P_{(j+3)+k}$, $P_{(j+4)k}$. When the highest voltage and the lowest voltage are applied to the deflecting control electrodes $Gd_{11}$ and $Gd_{12}$ at a timing $T_1$ shown in FIG. 3, respectively, electrons emitted from the cathodes 23 are greatly deflected due to a potential between the deflecting control electrodes $Gd_{11}$ and $Gd_{12}$ as indicated at an arrow a of dotted lines, so that they impinge on a phosphor layer of the picture cell $P_{jk}$, resulting in a luminous display. Subsequently, as indicated at timings $T_2$ to $T_5$ in FIG. 3, a voltage varied from the highest level to the lowest level by stages is applied to the deflecting control electrode $Gd_{11}$ and a voltage varied from the lowest level to the highest level by stages is applied to the deflecting control electrode $Gd_{12}$.

This causes the potential between both deflecting control electrodes $Gd_{11}$ and $Gd_{12}$ to be controlled, resulting in a degree of deflection of the electrons being controlled along paths indicated at arrows b-e in FIGS. 2.

To the control electrodes other than the deflecting control electrodes Gd is constantly applied a negative cut-off bias voltage. Also, to the diffusion electrode 27 is applied a positive or negative voltage for forcing the electrons toward the anode. A degree of diffusion of the deflected electron beam may be determined depending on a picture cell size required, because it can be controlled depending on a voltage applied to each of the control electrodes and diffusion electrode 27.

Figure 4:
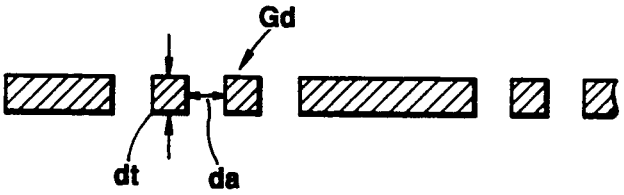
FIG. 4 is a sectional view showing a modification of control electrodes including deflecting control electrodes.
Figure 5:
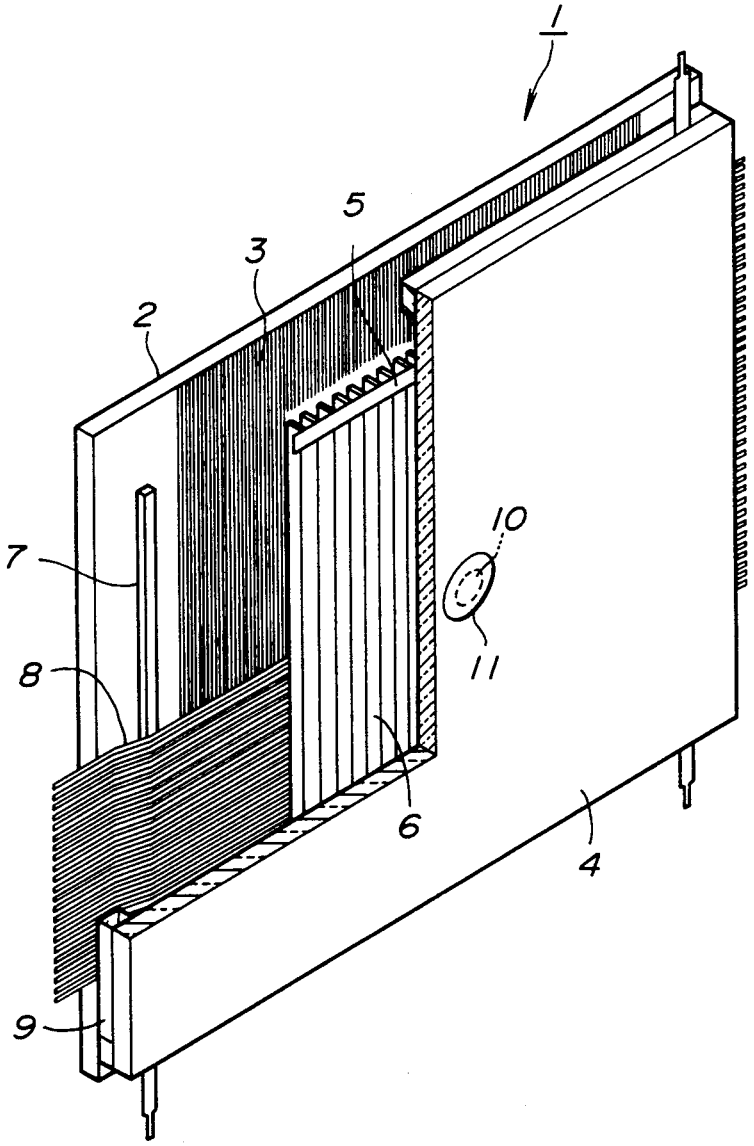
FIG. 5 PRIOR ART
FIG. 5 is a partly cutaway perspective view showing an example of a conventional graphic display device using a fluorescent display tube.

A configuration or structure of the control electrodes Gd is not limited to that shown in FIG. 2. For example, as shown in FIG. 4, the control electrodes may be integrally constructed except the deflecting control electrodes Gd. Such construction of the control electrodes causes the display device to be the so-called front emission type.

Also, in the illustrated embodiment, the deflecting control electrodes Gd, as shown in FIG. 4, each are preferably constructed in a manner such that its thickness dt is substantially equal to a width da of its opening for the purpose of improving convergence of the electron beam.

Figure 3:
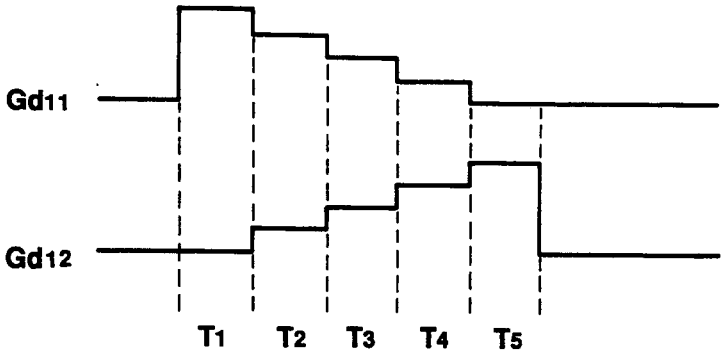
FIG. 3 is a timing chart showing a timing of deflecting control electrodes in the embodiment shown in FIG. 1.

Further, the voltage applied to the deflecting control electrodes Gd is not limited to such a stepwise voltage as shown in FIG. 3. It may be continuously increased or decreased.

In the display device of the present invention constructed as described above, supposing that the electron beam passing between each pair of the deflecting control electrodes is suitably deflected by the deflecting means, resulting in excitation of n picture cells; when the number of picture cells in a direction of arrangement of the control electrodes or a longitudinal direction of the anodes is K, the number of pairs of the deflecting control electrodes is $K \times 1/n$. Also, two drivers are required for each pair of the control electrodes, accordingly, the number of drivers required is $K \times 2/n$. For example, supposing that the number of steps of deflection of the electron beam is 5 ($n=5$) and the number of picture cells in a direction of arrangement of the control electrodes or a Y direction is 400, the number of drivers required is $400 \times 2/5 = 160$. Thus, it will be noted that the present invention substantially decreases the number of drivers, as compared with the fact that the conventional device requires 400 drivers.

Further, such a graphic display device is generally decreased in duty factor, so that application of a high voltage is required. This requires a driver constructed so as to withstand a high voltage, resulting in an increase in costs. However, the present invention significantly decreases the number of drivers, so that costs of the drivers and costs for manufacturing the device may be highly reduced.

In addition, the present invention permits a picture cell area covered by one cathode to be highly increased, so that the number of cathodes may be decreased, to thereby reduce power consumption.

Moreover, the present invention is so constructed that a negative cut-off bias voltage is constantly applied to the control electrodes other than the deflecting control electrodes. Such construction effectively prevents inflow of electrons to the control electrodes, resulting in utilization of electrons with high efficiency.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A display device comprising:

an anode group including phosphor-deposited anodes;

filamentary cathodes for emitting electrons;

a control electrode group including control electrodes connected in common an applied a negative voltage with respect to said filamentary cathodes and a pair of deflecting control electrodes adjacent each said filamentary cathode, said control electrode group being arranged above said anode group in a direction across said anode group;

said anode group and control electrode group being selectively driven to cause electrons emitted from said cathodes to impinge on regions of said anodes positioned at intersections between said anode group and said control electrode group and in proximity thereto, resulting in a luminous display;

said filamentary cathodes being stretchedly arranged above said control electrode group in a manner to be in parallel with said control electrode group and are interposed between said pair of deflecting control electrodes with at least two of said electrodes of said control electrode group being between any two adjacent filamentary cathodes;

deflecting means arranged below said filamentary cathodes for varying a potential between said pair of deflecting control electrodes adjacent each said filament cathode to deflect the electron beam emitted from said filamentary cathodes; and means for applying a predetermined potential to the control electrodes other than the deflecting control electrodes to which said deflection potential is applied.

2. A display device as defined in claim 1 further comprising a diffusion electrode which is arranged opposite to said control electrode group with said filamentary cathodes being interposed therebetween and to which a predetermined potential is applied.

3. A display device as defined in claim 1, wherein said deflecting control electrodes consist of a plurality of linear conductors.

4. A display device as defined in claim 1, wherein said control electrodes consist of a plate-like conductor.

5. A display device as defined in claim 1, wherein said deflecting control electrodes are applied a potential varying in stepwise from a high potential to the low level potential.

* * * * *